US010770784B2

(12) United States Patent
Tasker et al.

(10) Patent No.: US 10,770,784 B2
(45) Date of Patent: Sep. 8, 2020

(54) ANTENNA RADOME WITH ABSORBERS

(71) Applicant: COMMSCOPE TECHNOLOGIES LLC, Hickory, NC (US)

(72) Inventors: Allan Mitchell Tasker, Kirkcaldy (GB); Slavi Rumenov Baev, Edinburgh (GB)

(73) Assignee: CommScope Technologies LLC, Hickory, NC (US)

( * ) Notice: Subject to any disclaimer, the term of this patent is extended or adjusted under 35 U.S.C. 154(b) by 103 days.

(21) Appl. No.: 15/526,794

(22) PCT Filed: Nov. 20, 2015

(86) PCT No.: PCT/US2015/061805
§ 371 (c)(1),
(2) Date: May 15, 2017

(87) PCT Pub. No.: WO2016/089623
PCT Pub. Date: Jun. 9, 2016

(65) Prior Publication Data

US 2017/0358855 A1 Dec. 14, 2017

Related U.S. Application Data

(60) Provisional application No. 62/086,494, filed on Dec. 2, 2014.

(51) Int. Cl.
*H01Q 1/42* (2006.01)
*H01Q 17/00* (2006.01)
(Continued)

(52) U.S. Cl.
CPC ..... *H01Q 1/42* (2013.01); *H01Q 1/528* (2013.01); *H01Q 17/001* (2013.01); *H01Q 19/12* (2013.01); *H01Q 19/13* (2013.01)

(58) Field of Classification Search
USPC ..... 343/872
See application file for complete search history.

(56) References Cited

U.S. PATENT DOCUMENTS 5,191,351 A 3/1993 Hofer et al.
5,408,244 A 4/1995 Mackenzie
(Continued)

FOREIGN PATENT DOCUMENTS

EP 1398647 3/2004
EP 2804259 11/2014

OTHER PUBLICATIONS

Communication Pursuant to Article 94(3) EPC, corresponding to European Application No. 15 805 041.9, dated Feb. 5, 2020, 6 pages.

*Primary Examiner* — Trinh V Dinh
(74) *Attorney, Agent, or Firm* — Myers Bigel, P.A.

(57) ABSTRACT

In one embodiment, an antenna assembly includes a reflector antenna whose aperture is covered by a radome. The radome has a principle plane corresponding to the azimuth axis of the antenna. The radome has a bulk material and a pair of absorbers made of a radio-frequency (RF)-absorbent material different from the bulk material. The pair of absorbers are arranged symmetrically along the principle plane and about the center of the radome. The pair of absorbers are located near the perimeter of the radome and are at least partially embedded in the bulk material. The pair of absorbers cover from 4%-8% of the total aperture area of the antenna.

15 Claims, 5 Drawing Sheets

(51) Int. Cl.

| | |
|---|---|
| ***H01Q 19/12*** | (2006.01) |
| ***H01Q 1/52*** | (2006.01) |
| ***H01Q 19/13*** | (2006.01) |

(56) References Cited

U.S. PATENT DOCUMENTS

| | | | | |
|---|---|---|---|---|
| 6,674,392 | B1 | 1/2004 | Schmidt et al. | |
| 7,595,765 | B1 * | 9/2009 | Hirsch | H01Q 1/28 343/789 |
| 8,704,724 | B2 * | 4/2014 | Hook | H01Q 1/281 343/705 |
| 8,736,502 | B1 * | 5/2014 | Langfield | H01Q 19/06 343/753 |
| 10,224,640 | B2 * | 3/2019 | LeBayon | H01Q 19/13 |
| 2004/0036645 | A1 * | 2/2004 | Fujieda | G01S 7/032 342/70 |
| 2005/0035923 | A1 | 2/2005 | Syed et al. | |
| 2005/0190116 | A1 | 9/2005 | Syed et al. | |
| 2011/0234468 | A1 * | 9/2011 | Omuro | H01Q 1/40 343/840 |
| 2012/0306712 | A1 * | 12/2012 | Iwanaka | H01Q 15/14 343/781 P |
| 2016/0087345 | A1 * | 3/2016 | LeBayon | H01Q 1/42 343/840 |

* cited by examiner

ANTENNA RADOME WITH ABSORBERS

This application claims the benefit of the filing date of U.S. Provisional Application No. 62/086,494 filed on Dec. 2, 2014, the teachings of which are incorporated herein by reference in their entirety.

BACKGROUND

Field

The current disclosure relates to antennas and particularly, although not exclusively, to radomes for antennas.

Description of the Related Art

Microwave dish antennas, used for transmission of electromagnetic-radiation signals, are typically outfitted with an antenna shield and a radome for outdoor operation. The antenna shield functions to attenuate side-lobe and back-lobe radiation from the antenna, which may be required to avoid interference with other antennas and/or for regulatory compliance. Side lobes and back lobes refer to undesirable portions of an antenna's radiation pattern directed away from the forward direction—as opposed to the main lobe, which is the desired portion of the radiation pattern and is directed in the intended forward direction. The radome, meanwhile, provides environmental protection for the antenna from potential hazards such as rain, snow, ice, dirt, wind, and animals.

FIG. 1 is a top view of a conventional antenna assembly 100 including mount 101 for mounting the antenna assembly 100 on a pole (not shown), reflector dish 102 attached to the mount 101, cylindrical shield 103 mounted on the rim 104 of the dish 102, and radome 105 mounted on the outer rim 106 of the shield 103. The forward transmission direction for antenna assembly 100 is indicated by the arrow 107. The dish reflector 102 is a parabolic reflector that reflects the radiation generated by a radiating element, horn, or other feed element (not shown) located at the focus of the parabolic dish 102.

Cylindrical shield 103 comprises a metallic material on its exterior, exposed surface, and a microwave-absorbent material (not shown) on its interior surface facing the reflector 102 and its corresponding feed element. The combination of the absorbent material and the reflective metal works to minimize unwanted side-lobe and back-lobe radiation from the antenna assembly 100.

Conventional radomes, such as radome 105, may be made of a polymer fabric, or other suitable material, since conventional radomes are typically designed to be thin, lightweight, resistant to environmental degradation, and minimally interfering with microwave radiation. Radome 105 is stretched taut over the aperture of the shield 103 to, for example and among other reasons, minimize vibration of the antenna assembly 100 in windy conditions.

Note that some dish antennas are outfitted with only a radome and no shield, where the radome is mounted directly on the rim of the dish antenna, thereby covering the antenna aperture, but those antennas tend to have less-effective attenuation of side lobes and back lobes than shielded antennas.

FIG. 2 is a perspective view of a conventional antenna assembly 200 comprising a dish reflector 201 outfitted with a radome 202 and no shield. The forward direction of transmission is indicated by the arrow 204. Two semicircular clamps 203, located about the rim of the dish 201, hold the radome 202 in place. The clamps 203 may include a layer of radio-frequency-absorbing material in order to improve operational characteristics. Additional elements may further improve operational characteristics.

SUMMARY

One embodiment of the disclosure can be a radome for mounting on an aperture of a radio-frequency (RF) antenna. The radome comprises a bulk material and a set of one or more absorbers (i) comprising an RF-absorbent material different from the bulk material and (ii) at least partially embedded in the bulk material. The set of one or more absorbers is adapted to attenuate side-lobe and back-lobe radiation from the antenna.

BRIEF DESCRIPTION OF THE DRAWINGS

Other aspects, features, and advantages of the invention will become more fully apparent from the following detailed description, the appended claims, and the accompanying drawings in which like reference numerals identify similar or identical elements. Note that elements in the figures are not drawn to scale.

DETAILED DESCRIPTION

Detailed illustrative embodiments of the present invention are disclosed herein. However, specific structural and functional details disclosed herein are merely representative for purposes of describing example embodiments of the present invention. Embodiments of the present invention may be embodied in many alternative forms and should not be construed as limited to only the embodiments set forth herein. Further, the terminology used herein is for the purpose of describing particular embodiments only and is not intended to be limiting of example embodiments of the invention.

As used herein, the singular forms "a," "an," and "the," are intended to include the plural forms as well, unless the context clearly indicates otherwise. It further will be understood that the terms "comprises," "comprising," "has," "having," "includes," and/or "including" specify the presence of stated features, steps, or components, but do not preclude the presence or addition of one or more other features, steps, or components. It also should be noted that, in some alternative implementations, the functions/acts noted may occur out of the order noted in the figures.

In one embodiment, absorbers are integrated into a non-absorbent radome that can be mounted directly on a reflector antenna dish and which can attenuate side-lobe and back-lobe radiation without the use of a shield.

Figure 2:
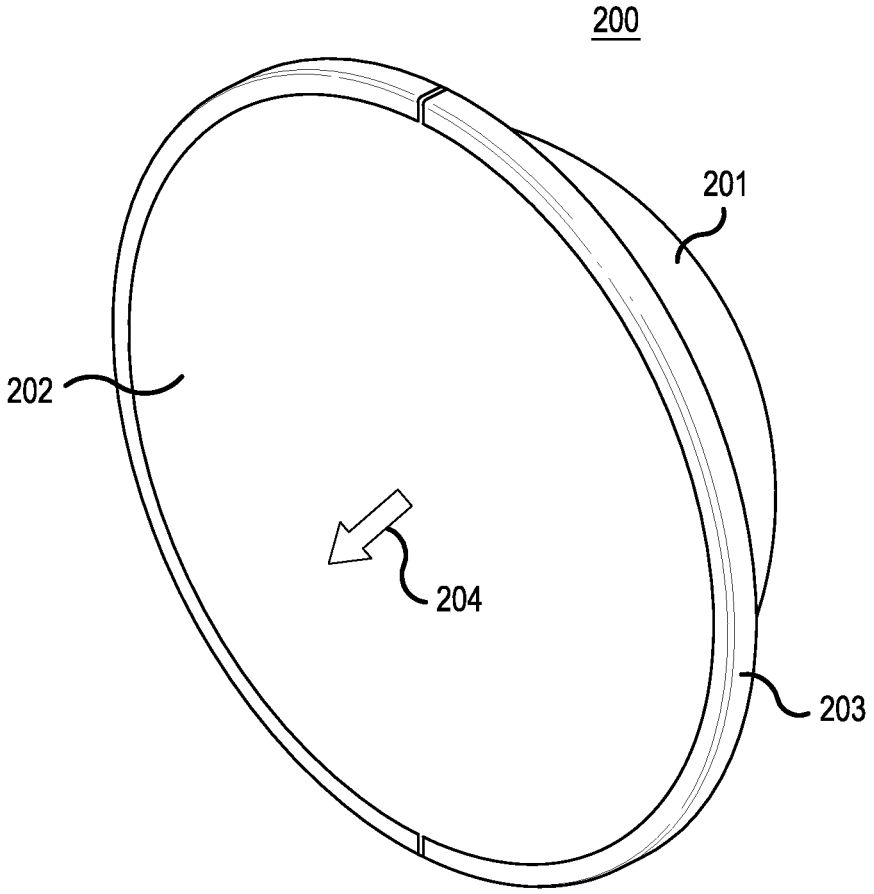
FIG.2 PRIOR ART
FIG. 2 is a perspective view of a conventional antenna assembly comprising a dish reflector outfitted with a radome and no shield.
Figure 3A:
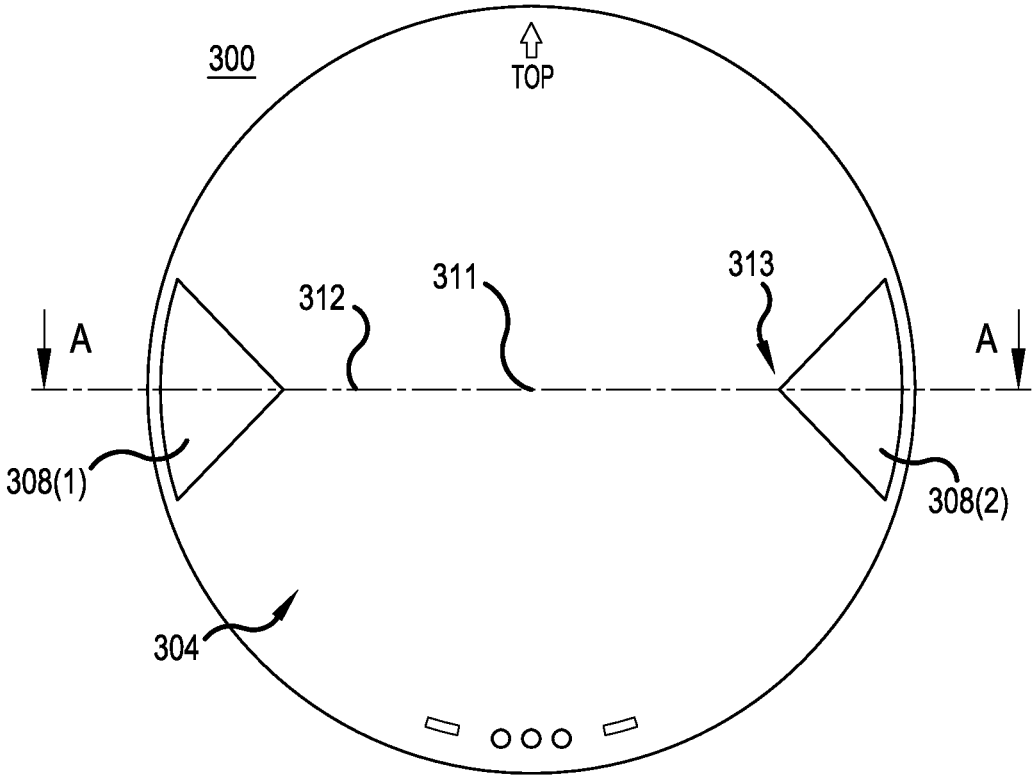
FIG. 3A is a back view of a radome in accordance with one embodiment of the disclosure.
Figure 3B:
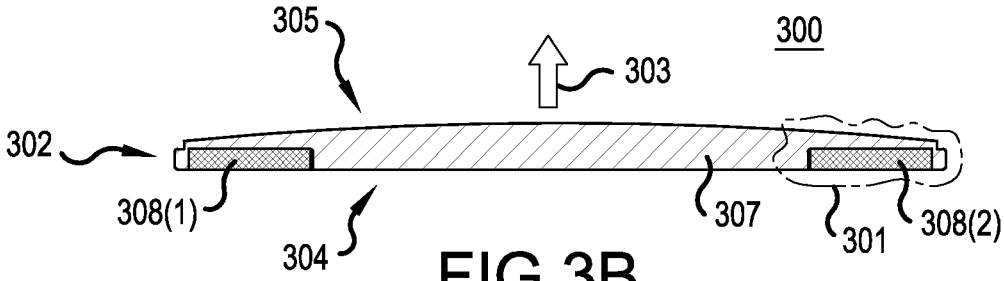
FIG. 3B is a cross-sectional top view of the radome of FIG. 3A.
Figure 3C:
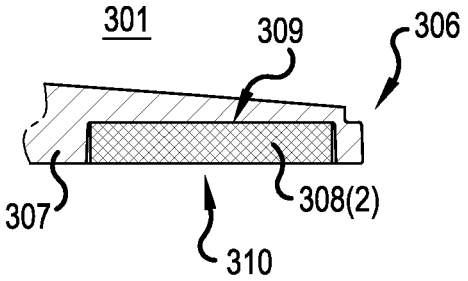
FIG. 3C is an enlargement of the detail area of FIG. 3B.
Figure 3D:
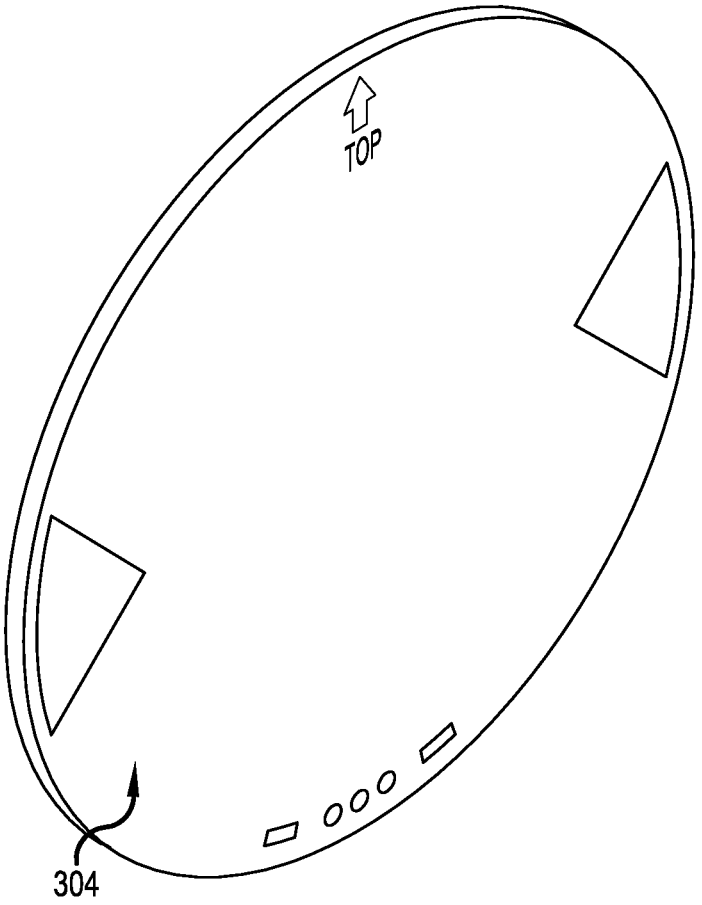
FIG. 3D is a perspective view of the radome of FIG. 3A.

FIG. 3A is a back view of a radome 300 in accordance with one embodiment of the disclosure. FIG. 3B is a cross-sectional top view of the radome 300 of FIG. 3A along line A-A. FIG. 3C is an enlargement of detail area 301 of FIG. 3B. FIG. 3D is a perspective view of radome 300 of FIG. 3A. Note that the radome 300 may be used in place of the radome 202 in the antenna assembly 200 of FIG. 2, where the radome 300 may be mounted directly on the dish 201—with or without the semi-circular clamps 203.

Figure 1:
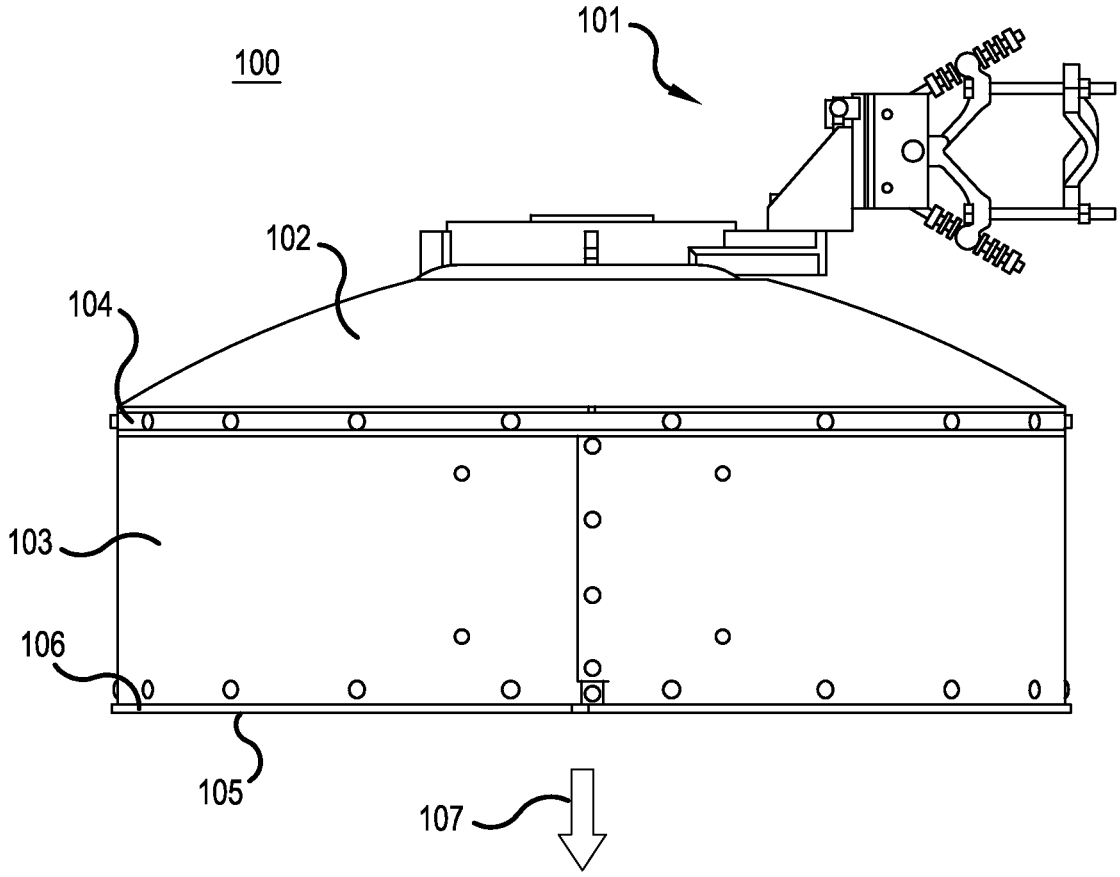
FIG.1 PRIOR ART
FIG. 1 is a top view of a conventional antenna assembly including a mount, a reflector dish, a cylindrical shield, and a radome.

Radome 300 is substantially disc-shaped and designed for mounting on a corresponding dish antenna (not shown), such as, for example, conventional dish 102 of FIG. 1 or conventional dish 201 of FIG. 2, where a perimeter 302 of the radome 300 would mount on or in the corresponding rim of the dish—such as, for example, rim 104 of dish 102. The forward direction of transmission for the corresponding antenna is represented by the arrow 303 of FIG. 3B. The radome 300 has an interior surface 304, which is also called the signal surface since it is the side facing the corresponding reflector antenna. The interior surface 304 is flat. Note, however, that in alternative embodiments, the interior surface 304 may be curved, ridged, or otherwise non-flat.

Radome 300 has an exterior surface 305 which faces away from the corresponding reflector antenna—in other words, opposite to the interior surface 304. Note that the perimeter 302 is a surface that connects the interior surface 304 to the exterior surface 305. The exterior surface 305 is slightly convex. Note, however, that in alternative embodiments, exterior surface 305 may be flat or curved differently from the embodiment shown. Specifically, the curvature may be concave, ridged, grooved, or the curvature may be otherwise non-convex. The radome 300 has a notch 306 at the interface of the exterior surface 305 and the circumferential perimeter 302 in order to fit the radome 300 securely and/or properly to the rim of the corresponding antenna and/or a corresponding circular clamp (not shown), such as the clamp 203 of FIG. 2. In alternative embodiments, other notches, grooves, or recesses may be located on or near the circumferential perimeter 302.

Figure 3E:
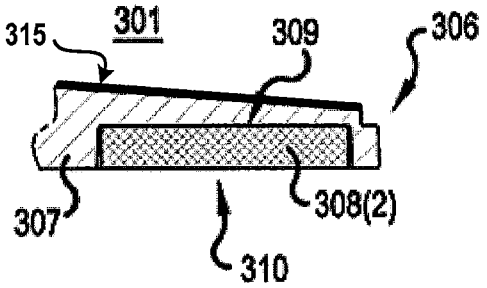
FIG. 3E is an enlargement of the detail area of FIG. 3B in accordance with an embodiment of the disclosure.

The bulk 307 of the radome 300 may comprise a light-weight material, such as, for example, expanded polystyrene or extruded polystyrene foam, that is minimally absorbent of—in other words, largely transparent to—microwave radiation. As seen in FIG. 3E, exterior surface 305 may include a protective coating 315 comprising a harder and/or moisture-resistant material, such as, for example, epoxy or other polymer film, in order to provide superior physical protection to the radome 300 and the corresponding antenna. Note that the bulk material 307 and the protective material 315 should be formulated and shaped so as to minimize negative impact on the transmission efficacy of the corresponding antenna. In other words, the bulk material 307 and the protective coating 315 should be substantially transparent to RF signals over the relevant frequency range. Note that one should, nevertheless, preferably account for any reflection and absorption of radiation by the radome 300 across the intended transmission frequencies for the antenna assembly incorporating the radome 300 and the corresponding antenna.

Radome 300 comprises absorbers 308(1) and 308(2). The absorbers 308 comprise a radio-frequency(RF)-absorbing material such as, for example, a carbon-loaded foam. One example of a carbon-loaded foam is Eccosorb HR foam from Emerson & Cuming Microwave Products N.V. of Geel, Belgium. Eccosorb HR foam—which is based on a reticulated (open-cell) polyurethane foam material impregnated with carbon black dispersions with controlled conductivity—is electrically conductive, and operates in the 5-70 GHz frequency range. Each absorber 308 may also include a metallic foil (not shown) on its exterior side 309 for improved absorption. Absorbers 308 may alternatively comprise flexible elastomers, rigid epoxy, and/or plastics.

The absorbers 308 are arranged near the perimeter 302—or outer rim—of the radome 300. Specifically, the absorbers 308 are located between a halfway point 312 from the center 311 and the perimeter 302. Note, however, that, in alternative embodiments, the absorbers 308 may extend out to the perimeter 302 of the radome 300 or may extend inward past the halfway point 312. The absorbers 308 are symmetrically arranged along and about the principle plane—also called the azimuth axis—of the radome 300, where the principle plane corresponds to the line A-A in FIG. 3A. In other words, the absorbers 308 are symmetric about the principle plane and about the center 311 of the radome 300. Note, however, that in alternative embodiments, the absorbers 308 may be differently arranged about the center 311 and/or the principle axis. Note, also, that, in alternative embodiments, the radome 300 may comprise a different number of absorbers 308.

Absorbers 308 are substantially quadrant-like or wedge-like in shape, with the apex 313 of the absorber 308 pointing towards the center 311. Note, however, that in alternative embodiments, the absorbers 308 may have different shapes. In these alternative embodiments, the absorbers should be shaped and sized to sufficiently attenuate side-lobe and/or back-lobe radiation without excessively attenuating the antenna gain. In some embodiments, the area of the antenna aperture (and, consequently, of the radome) that is covered by absorbers 308 is 4-8% of the total area of the aperture. In some embodiments, a particularly useful balance between desired side-lobe and back-lobe attenuation and antenna-gain reduction may be achieved by using a coverage area of 5-7% of the total aperture/radome area.

Figure 3F:
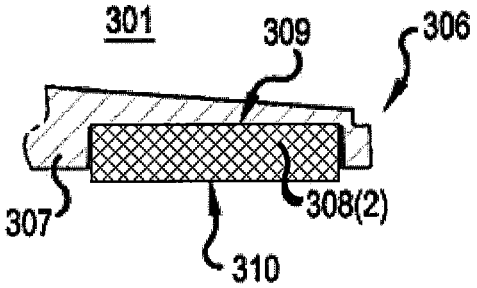
FIG. 3F is an enlargement of the detail area of FIG. 3B in accordance with an embodiment of the disclosure.

The absorbers 308 are located inside correspondingly shaped recesses in radome 300. The absorbers 308 may be secured in place using only friction or may be attached to the bulk material 307 using an adhesive (not shown) or mechanical fasteners (not shown). The interior surface 310 of each absorber 308 may be substantially flush with the interior surface 304 of the radome 300. Note, however, that in alternative embodiments, one example of which is shown in FIG. 3F, the interior surface 310 of one or more absorbers 308 may extend beyond or lie inside of the radome's interior surface 304. In some alternative embodiments, the absorbers 308 may be embedded within the bulk material 307 of the radome 300.

The absorbers 308 may have a substantially uniform thickness as seen in the cross-sectional view of FIG. 3B. Note, however, that in alternative embodiments, the absorbers 308 have a variable thickness. The recesses for absorbers 308 are shown as partial recesses on the interior surface 304. Note, however, that in some alternative embodiments, the recesses—and, optionally, the absorbers 308—may extend out to the exterior surface 305 of the radome 300 so that the absorbers 308 may be flush with the exterior surface 305—or may even extend beyond the exterior surface 305. Note that, in the various above-described embodiments, the absorbers 308 may be considered to be at least partially embedded in the bulk material 307.

As noted above, unwanted side lobes and back lobes, which may degrade antenna performance, are caused by electromagnetic energy transmitted in a direction different from the forward transmission direction and in particular over the periphery of the dish. The absorbers 308, placed at the periphery of the dish, comprise carbon-loaded material with RF-absorbent and electrically conductive properties, and those properties cause gradual reduction (attenuation) of the energy penetrating the absorbers, thereby reducing the energy transmitted over the periphery of the dish and forming the side lobes and back lobes.

Embodiments of the disclosure have been described where the radome 300 is circular and adapted for mounting on a dish antenna having a corresponding circular aperture. Note, however, that the invention is not so limited and that, in alternative embodiments, the radome may have a non-circular shape and be adapted for mounting on an antenna with a corresponding non-circular aperture. Such apertures may be, for example, oval or rectangular.

In certain embodiments of the disclosure, an antenna assembly comprises a reflector antenna whose aperture is covered by a radome. The radome has a principle plane corresponding to the azimuth axis of the antenna. The radome comprises a bulk material and one or more absorbers comprising an RF-absorbent material different from the bulk material. The absorbers may be arranged along the principle plane and near the perimeter of the radome. The absorbers may cover from 4%-8% of the total aperture area of the antenna.

Other embodiments of the disclosure may be the radomes for such antenna assemblies, where each radome comprises at least one absorber.

It will be understood that various changes in the details, materials, and arrangements of the parts which have been described and illustrated in order to explain the nature of this invention may be made by those skilled in the art without departing from the scope of the invention as expressed in the following claims.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

Unless explicitly stated otherwise, each numerical value and range should be interpreted as being approximate as if the word "about" or "approximately" preceded the value of the value or range. As used in this application, unless otherwise explicitly indicated, the term "connected" is intended to cover both direct and indirect connections between elements.

For purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. The terms "directly coupled," "directly connected," etc., imply that the connected elements are either contiguous or connected via a conductor for the transferred energy.

The use of figure numbers and/or figure reference labels in the claims is intended to identify one or more possible embodiments of the claimed subject matter in order to facilitate the interpretation of the claims. Such use is not to be construed as limiting the scope of those claims to the embodiments shown in the corresponding figures.

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

Although the steps in the following method claims are recited in a particular sequence with corresponding labeling, unless the claim recitations otherwise imply a particular sequence for implementing some or all of those steps, those steps are not necessarily intended to be limited to being implemented in that particular sequence.

We claim:

1. A radome for mounting on an aperture of a radio-frequency (RF) antenna, the radome comprising:

a bulk material having a disk shape and comprising an interior surface configured to face toward a reflector surface of the RF antenna, wherein the interior surface comprises a plurality of wedge-shaped recesses symmetrically arranged around a center of the radome, and wherein each wedge-shaped recess is dimensioned such that an apex thereof points toward the center of the bulk material; and a plurality of wedge-shaped absorbers, wherein each of the plurality of wedge-shaped absorbers is at least partially embedded in the bulk material in a respective one of the plurality of wedge-shaped recesses, and wherein each of the plurality of wedge-shaped absorbers comprises an RF-absorbent material that is different from the bulk material and that is adapted to attenuate side-lobe and back-lobe radiation from the antenna.

2. The radome of claim 1, wherein an exterior surface of the bulk material that is opposite from the interior surface is convex.

3. The radome of claim 2, further comprising a protective coating on the exterior surface, wherein the protective coating is harder and more resistant to moisture than the bulk material.

4. The radome of claim 1, wherein each of the plurality of wedge-shaped absorbers comprises an interior surface configured to face toward the reflector surface of the RF antenna, and wherein the interior surfaces of the wedge-shaped absorbers are flush with the interior surface of the bulk material.

5. The radome of claim 1, wherein the bulk material is substantially transparent to RF signals within a predetermined frequency range.

6. The radome of claim 1, wherein the bulk material comprises polystyrene.

7. The radome of claim 1, wherein the RF-absorbent material is electrically conductive carbon-loaded foam.

8. The radome of claim 1, wherein each of the plurality of wedge-shaped absorbers comprises an interior surface configured to face toward the reflector surface of the RF antenna, and wherein each wedge-shaped absorber of the plurality of wedge-shaped absorbers comprises metallic foil on an exterior surface of the wedge-shaped absorber that is opposite from the interior surface.

9. The radome of claim 1, wherein the wedge-shaped absorbers cover 4-8% of an area of the aperture of the antenna.

10. The radome of claim 1, wherein the wedge-shaped absorbers are embedded in the wedge-shaped recesses in the bulk material using only friction and without any adhesive.

11. An antenna assembly comprising:

a radio-frequency (RF) antenna comprising a reflector dish;

a radome mounted to an outer rim of the reflector dish, wherein the radome comprises:

a bulk material having a disk shape and comprising an interior surface facing toward the reflector dish, wherein the interior surface comprises a plurality of recesses symmetrically arranged around a center of the radome; and a plurality of wedge-shaped absorbers, wherein each of the plurality of wedge-shaped absorbers is at least partially embedded into the bulk material in a respective one of the plurality of recesses, wherein each wedge-shaped absorber is dimensioned such that an apex thereof points toward the center of the bulk material, wherein each of the wedge-shaped absorbers comprises an interior surface facing toward the reflector dish, and wherein each of the plurality of wedge-shaped absorbers comprises an RF-absorbent material that is different from the bulk material and that is adapted to attenuate side-lobe and back-lobe radiation from the antenna.

12. The antenna assembly of claim 11, wherein the radome is mounted directly on a rim of the RF antenna.

13. The antenna assembly of claim 11, wherein the interior surfaces of the wedge-shaped absorbers are closer to the reflector dish than the interior surface of the bulk material.

14. A radome for mounting on an aperture of a radio-frequency (RF) antenna, the radome comprising:

a bulk material having a disk shape and comprising an interior surface configured to face toward a reflector surface of the RF antenna and an exterior surface opposite from the interior surface; and a plurality of wedge-shaped absorbers embedded in the bulk material and symmetrically arranged around a center of the bulk material, wherein each wedge-shaped absorber comprises an apex that points toward the center of the bulk material, wherein each wedge-shaped absorber extends from the interior surface of the bulk material to the exterior surface of the bulk material, and wherein each of the plurality of wedge-shaped absorbers comprises an RF-absorbent material that is different from the bulk material and that is adapted to attenuate side-lobe and back-lobe radiation from the antenna.

15. The radome of claim 14, wherein the radome is configured to mount directly on a rim of the RF antenna.

* * * * *